US007189067B2

(12) United States Patent
Yoo et al.

(10) Patent No.: US 7,189,067 B2
(45) Date of Patent: Mar. 13, 2007

(54) SCROLL COMPRESSOR HAVING VACUUM PREVENTING STRUCTURE

(75) Inventors: Byung-Kil Yoo, Seoul (KR); Se-Hyeon Choi, Seoul (KR); Jung-Won Nam, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/034,746

(22) Filed: Jan. 14, 2005

(65) Prior Publication Data

US 2006/0057009 A1 Mar. 16, 2006

(30) Foreign Application Priority Data

Sep. 10, 2004 (KR) ..... 10-2004-0072691
Sep. 10, 2004 (KR) ..... 10-2004-0072693

(51) Int. Cl.
*F03C 2/00* (2006.01)
*F04C 18/00* (2006.01)

(52) U.S. Cl. ..... 418/55.5; 418/57; 418/55.1; 417/308; 417/310

(58) Field of Classification Search ..... 418/55.1–55.5, 418/57; 417/308, 310; 137/538
See application file for complete search history.

(56) References Cited

U.S. PATENT DOCUMENTS

| | | | | |
|---|---|---|---|---|
| 4,790,347 | A * | 12/1988 | Weirich et al. | 137/538 |
| 6,190,138 | B1 * | 2/2001 | Hugenroth et al. | 417/310 |
| 6,769,881 | B2 * | 8/2004 | Lee | 418/55.1 |
| 6,863,510 | B2 * | 3/2005 | Cho | 418/55.1 |
| 2003/0202886 | A1 * | 10/2003 | Choi | 417/310 |

FOREIGN PATENT DOCUMENTS

| | | | |
|---|---|---|---|
| JP | 02021078 | A * | 1/1990 |
| JP | 03267591 | A * | 11/1991 |
| JP | 05-280476 | A | 10/1993 |
| KR | 2001-0055305 | A | 7/2001 |
| KR | 2001076882 | A * | 8/2001 |
| KR | 2002031620 | A * | 5/2002 |
| KR | 2003-0085747 | A | 11/2003 |
| KR | 2004098457 | A * | 11/2004 |

* cited by examiner

*Primary Examiner*—Theresa Trieu
(74) *Attorney, Agent, or Firm*—Birch, Stewart, Kolasch & Birch, LLP

(57) ABSTRACT

A scroll compressor having a vacuum preventing structure includes: a casing forming a receiving space therein; a fixed scroll fixed to a main frame installed in the casing, and including a back pressure passage at an outer side surface thereof, a discharge pressure hole formed at one side of the back pressure passage such that the back pressure passage and a discharge pressure space of the casing can communicate with each other, a middle pressure hole formed at another side of the back pressure passage such that the back pressure passage and a compression space of the casing can communicate with each other, and a suction pressure hole formed at still another side of the back pressure passage such that the back pressure passage and a suction pressure space can communicate with each other; an orbiting scroll positioned between the fixed scroll and the main frame and forming a compression space by being coupled with the fixed scroll; a piston slidably installed in the back pressure passage, for opening or closing the discharge pressure hole; an elastic member installed in the back pressure passage, for supporting the piston; and a stopper for closing an inlet of the back pressure passage.

17 Claims, 5 Drawing Sheets

SCROLL COMPRESSOR HAVING VACUUM PREVENTING STRUCTURE

BACKGROUND OF THE INVENTION

1. Field of the Invention

The present invention relates to a scroll compressor having a vacuum preventing structure, and more particularly, to a scroll compressor having a vacuum preventing structure capable of preventing a vacuum of the compressor by making a gas of a discharge pressure side backflow toward a suction pressure side during the abnormal operation such as the pump down or clogging of an expansion valve.

2. Description of the Background Art

In general, a compressor changes mechanical energy into latent energy of compression fluid, and is classified into a reciprocating type compressor, a scroll type compressor, a centrifugal type compressor and a vane type compressor.

Among them, unlike the reciprocating type compressor using linear reciprocation of an opening/closing member, the scroll type compressor sucks, compresses and discharges a gas by using a rotation body like the centrifugal type compressor or the vane type compressor.

FIG. 1 is a longitudinal sectional view showing the conventional scroll compressor, and FIG. 2 is an enlarged view showing an important part of FIG. 1.

As shown therein, the conventional scroll compressor includes: a casing 11 forming a receiving space therein; a compression part 31 received and installed in the casing 11, for compressing a refrigerant; and a motor part 21 for supplying a driving force to the compression part 31.

A suction pipe 13 and a discharge pipe 15 for sucking and discharging a refrigerant is formed at one side of the casing 11, and an upper frame 17 and a lower frame 19 are separately and vertically installed in the casing in order to support the compression part 31 and the motor part 21.

The compression part 31 includes a fixed scroll 33 having a wrap 34 of an involute shape and fixedly installed at the upper frame 17 and an orbiting scroll 35 having a wrap 37 of an involute shape, coupled with the fixed scroll 33 to reciprocally form a compression space (S), and compressing a refrigerant while performing the relative motion with respect to the fixed scroll 33.

A high/low pressure separation plate 39 for separating the inside of the casing 11 into a discharge pressure space (S2) and a suction pressure space (S1) is coupled with the fixed scroll 33.

The motor part 21 includes a stator 23 fixedly installed in the casing 11 and a rotor 25 rotatably received and installed in the stator 23 on the basis of a rotary shaft 27 having an eccentric portion 28 at its one side.

Meanwhile, in case of the pump down or in case that an expansion valve is clogged, the suction pressure space (S1) becomes in a high vacuum. At this time, the constituting parts of the compressor can be damaged by fire or broken.

To prevent this problem, there is provided a vacuum preventing device 41 in the conventional art.

The vacuum preventing device 41 includes: a back pressure passage 43 formed at a predetermined depth along a radial direction from a side surface of the fixed scroll 33; a discharge pressure hole 44 formed at an upper portion of the back pressure passage 43 to make the back pressure passage 43 communicate with the discharge pressure space (S2); a middle pressure hole 45 formed at a lower portion of the back pressure passage 53 to make the back pressure passage 43 communicate with the compression space (S); a piston 47 slidably received in the back pressure passage 43, for opening or closing the discharge pressure hole 44; a spring 48 for applying an elastic force at the piston 47 such that the piston 47 can move from its one side to a position where the piston 47 opens the discharge pressure hole 44; a stopper 46 inserted into an inlet side of the back pressure passage 43; and a fixing pin 50 for fixing the stopper 46 to prevent separation of the stopper 46.

A suction pressure hole 49 for connecting the back pressure passage 43 with the suction pressure space (S1) is penetratingly formed at the center of the stopper 46. A pin hole 36 for inserting and coupling the fixing pin 50 into the fixed scroll 33 is formed at the fixed scroll 33.

However, in the conventional scroll compressor having such a construction, the piston and the spring are mounted in the back pressure and the stopper is fixed by inserting the fixing pin into the pin hole, thereby causing an assembly to be difficult. In addition, since the pin hole is positioned at an outer edge of the fixed scroll 33, intensity around the pin hole is low and therefore the fixed scroll can be easily damaged.

In addition, a refrigerant gas in the discharge pressure space (S2) flows into the back pressure 53 through the discharge pressure hole 44, and the refrigerant gas having flowed into the back pressure 53 flows into the suction pressure space (Si) through the suction pressure hole 49. At this time, the high temperature refrigerant gas receives flow resistance, thereby stopping the driving of the motor part 21. Accordingly, it takes relatively much time to release the vacuum of the scroll compressor.

SUMMARY OF THE INVENTION

Therefore, an object of the present invention is to provide a scroll compressor having a vacuum preventing structure providing easy assembly and capable of quickly and effectively preventing damage to parts during the abnormal operation.

To achieve these and other advantages and in accordance with the purpose of the present invention, as embodied and broadly described herein, there is provided a scroll compressor having a vacuum preventing structure comprising: a casing forming a receiving space therein; a fixed scroll fixed to a main frame installed in the casing, and including a back pressure passage at an outer side surface thereof, a discharge pressure hole formed at one side of the back pressure passage such that the back pressure passage and a discharge pressure space of the casing can communicate with each other, a middle pressure hole formed at another side of the back pressure passage such that the back pressure passage and a compression space of the casing can communicate with each other, and a suction pressure hole formed at still another side of the back pressure passage such that the back pressure passage and a suction pressure space can communicate with each other; an orbiting scroll positioned between the fixed scroll and the main frame and forming a compression space by being coupled with the fixed scroll; a piston slidably installed in the back pressure passage, for opening or closing the discharge pressure hole; an elastic member installed in the back pressure passage, for supporting the piston; and a stopper for closing an inlet of the back pressure passage.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a scroll compressor having a vacuum preventing structure in accordance with the present invention will be described, referring to the accompanying drawings.

Figure 1:
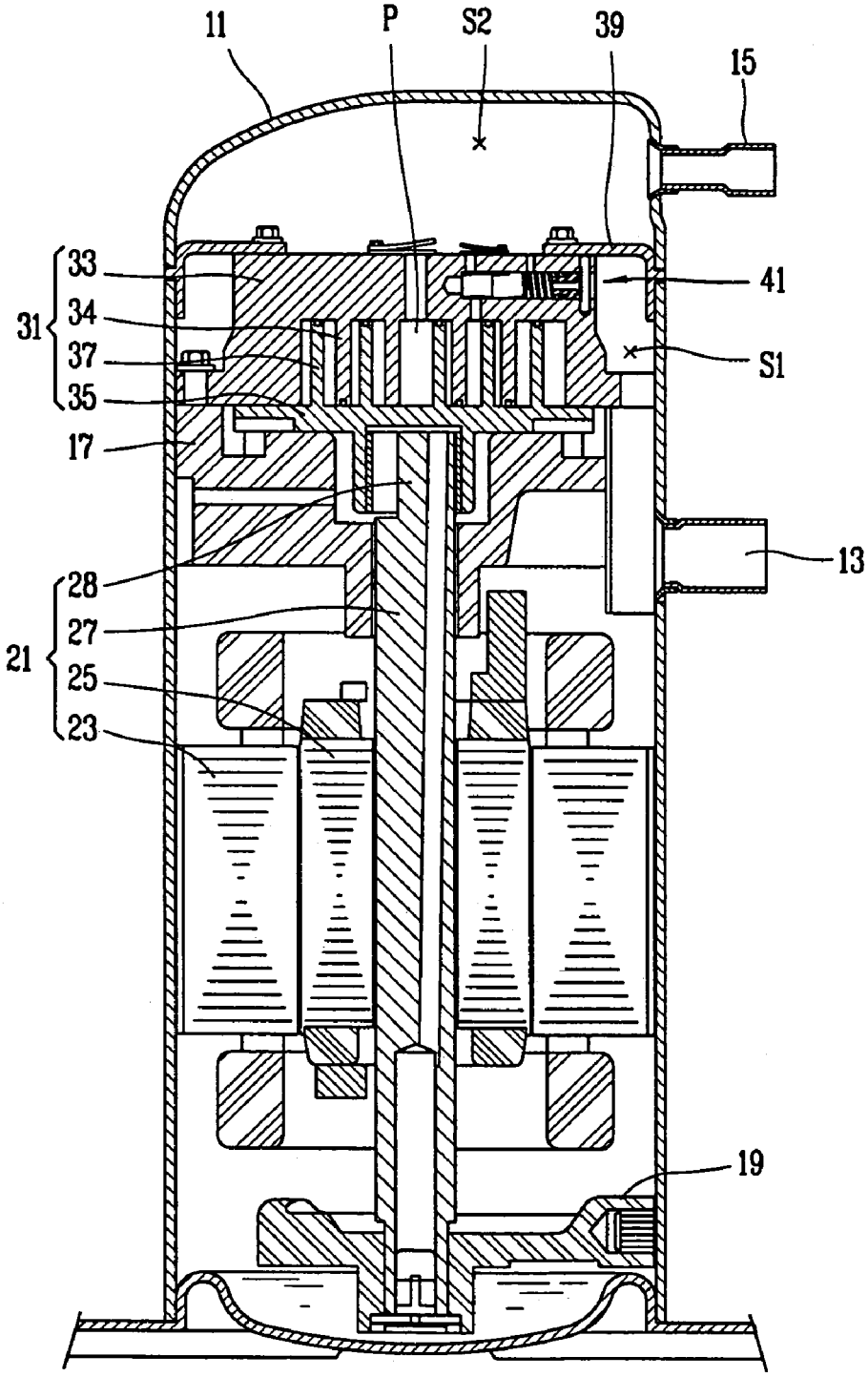
FIG. 1 CONVENTIONAL ART
FIG. 1 is a longitudinal sectional view showing the conventional scroll compressor.
Figure 2:
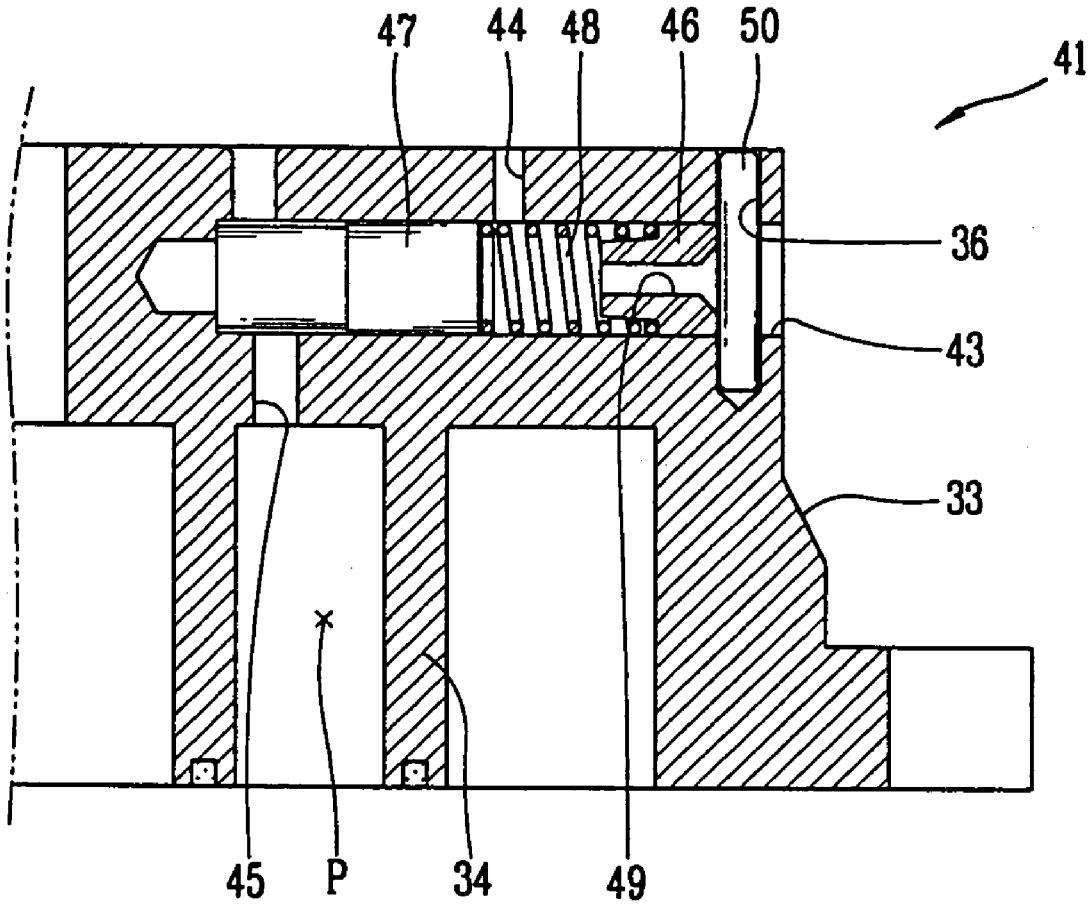
FIG. 2 CONVENTIONAL ART
FIG. 2 is an enlarged view showing an important part of FIG. 1.
Figure 3:
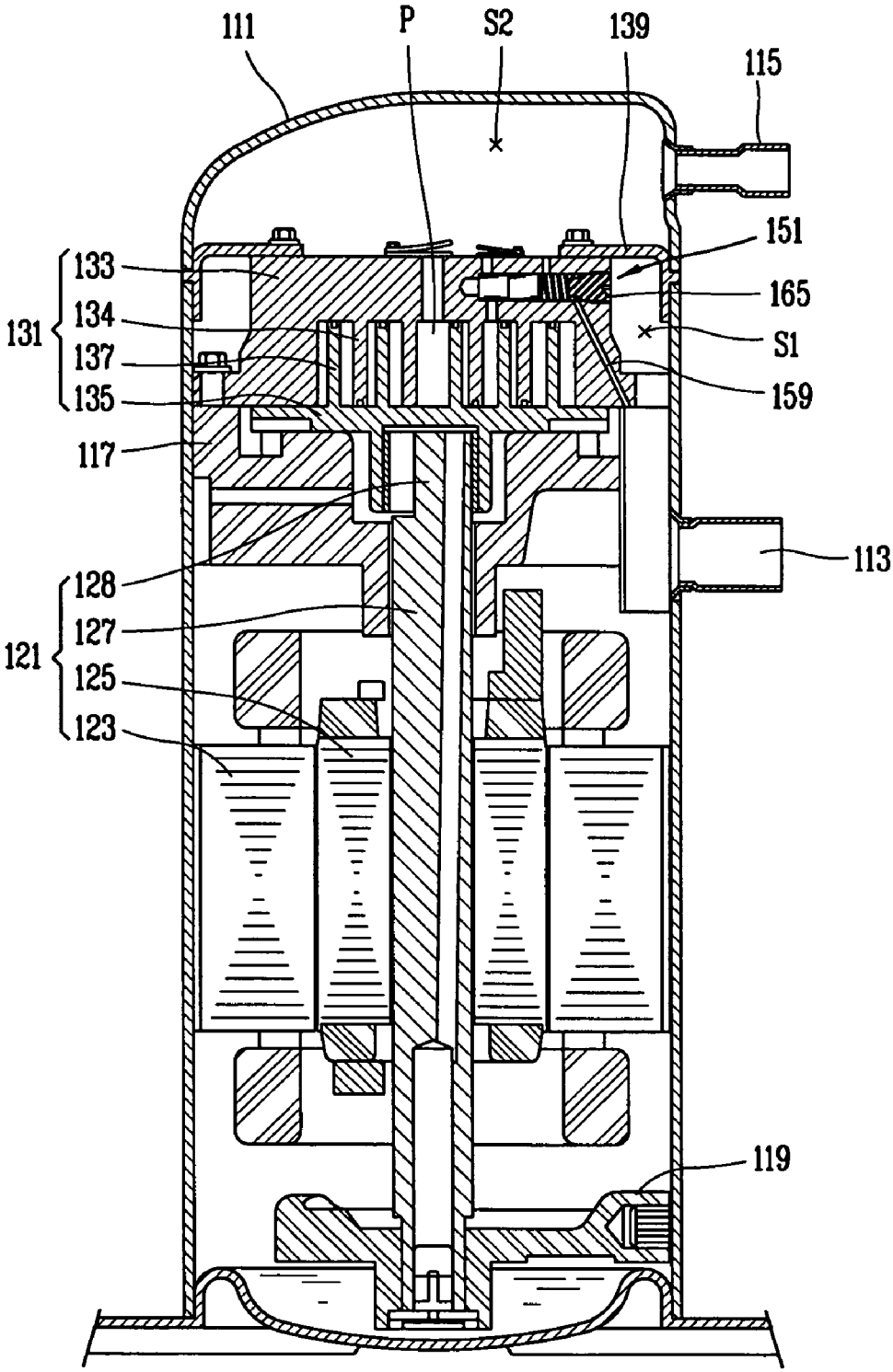
FIG. 3 is a longitudinal sectional view showing a scroll compressor having a vacuum preventing structure in accordance with one embodiment of the present invention.
Figure 4:
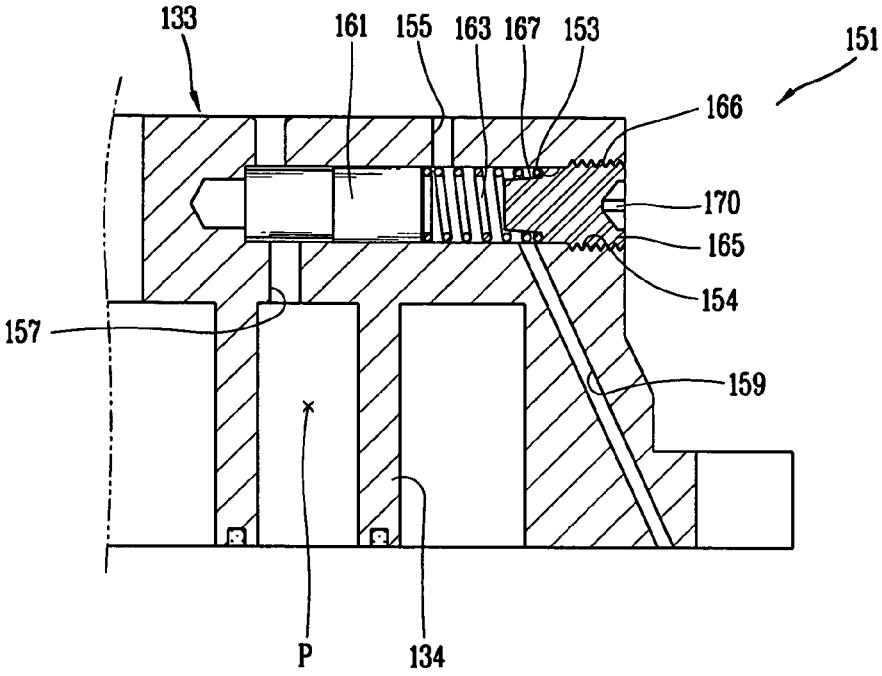
FIG. 4 is an enlarged view showing an important part of FIG. 3.
Figure 5:
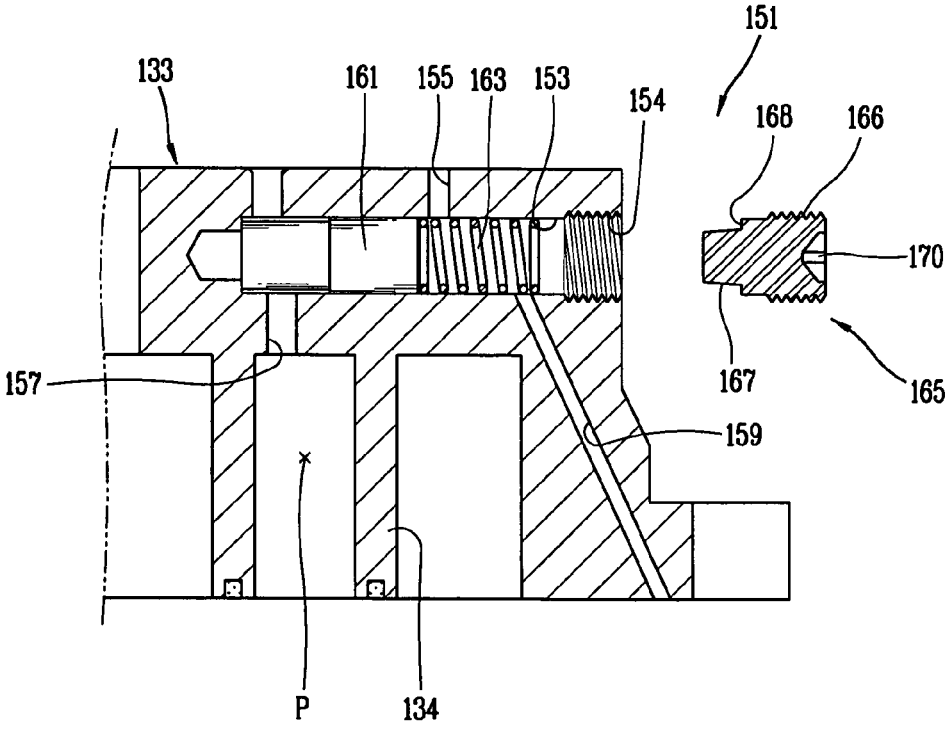
FIG. 5 is a longitudinal sectional view showing a stopper coupled with a back pressure passage in the scroll compressor having the vacuum preventing structure in accordance with one embodiment of the present invention.
Figure 6:
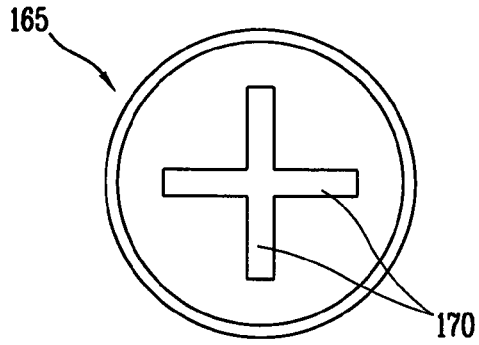
FIG. 6 is a side view showing the stopper in the scroll compressor having the vacuum preventing structure in accordance with one embodiment of the present invention.

FIG. 3 is a longitudinal sectional view showing a scroll compressor is having a vacuum preventing structure in accordance with one embodiment of the present invention, FIG. 4 is an enlarged view showing an important part of FIG. 3, FIG. 5 is a longitudinal sectional view showing a stopper coupled with a back pressure passage in the scroll compressor having the vacuum preventing structure in accordance with one embodiment of the present invention, and FIG. 6 is a side view showing the stopper in the scroll compressor having the vacuum preventing structure in accordance with one embodiment of the present invention.

As shown therein, the scroll compressor having the vacuum preventing structure in accordance with one embodiment of the present invention includes: a casing 111 forming a hermetic receiving space therein; a compression part 131 received in the casing 111, for compressing a refrigerant; and a motor part 121 for supplying a driving force to the compression part 131. The motor part 121 includes a stator 123 fixedly installed in the casing 111 and a rotor 125 rotatably installed in the stator 123 on the basis of a rotary shaft 127 having an eccentric portion 128 at its one side.

The compression part 131 includes: a fixed scroll 133 having a wrap 134 of an involute shape and fixedly installed at an upper frame 117, and an orbiting scroll 135 having a wrap 137 of an involute shape, coupled with the fixed scroll 133 to reciprocally form a compression space (P) of a refrigerant, having its lower portion coupled with the eccentric portion 128, and compressing a refrigerant while performing the relative motion with respect to the fixed scroll 133. A high/low pressure separation plate 139 for separating the inside of the casing 111 into a discharge pressure space (S2) and a suction pressure space (S1) is coupled with an upper surface of the fixed scroll 133.

Meanwhile, a vacuum preventing device 151 for preventing the compression progress in a state that the inside of the casing 111 is vacuumized is installed at the fixed scroll 133.

In the vacuum preventing device 151 of the scroll compressor in accordance with the present invention, a back flow passage 153 is formed at a side surface of the fixed scroll 133 at a predetermined depth, a discharge pressure hole 155 for making the back pressure passage 153 communicate with the discharge pressure space (S2) is formed at an upper portion of the back pressure passage 153, a middle pressure hole 157 for making the back pressure passage 153 communicate with the compression space (P) is formed at one side of a lower portion of the back pressure passage 153, and a suction pressure hole 159 for making the back pressure passage 153 communicate with the suction pressure space (S1) is formed at the other side of the back pressure passage 153.

The back pressure passage 153 is formed in parallel with an upper surface of the fixed scroll 133, and the suction pressure hole 159 is inclined with respect to the back pressure passage 153.

A piston 161 is slidably installed in the back pressure passage 153 so as to selectively open or close the discharge pressure hole 155 during the abnormal operation such as the pump down or clogging of an expansion valve.

A stopper 165 for closing the back pressure passage 153 is installed at an inlet of the back pressure passage 153, and a spring 163 is installed between the piston 161 and the stopper 165.

One side of the spring 163 is fixed to the stopper 165, and the other side of the spring 163 is fixed to the piston 161.

The piston 161 closes the discharge pressure hole 155 during the normal operation, and the piston 161 moves only during the abnormal operation to connect the discharge pressure hole 155 with the suction pressure hole 159.

A spring support portion 168 contacting with an end portion of the spring 163 and supporting the spring 163 is formed on an end portion of the insertion side of the stopper 165 inserted into the back pressure passage 153. A guide portion 167 which protrudes from the spring support portion 168 with its diameter gradually decreasing along a longitudinal direction of the back pressure passage 153 is formed on one side of the spring support portion 168 in order that the end portion of the spring 163 can be guided to the spring support portion 168.

A female screw portion 154 is formed on an inlet of the back pressure passage 153, and a male screw portion 166 screw-coupled with the female screw portion 154 is formed on the stopper 165. A tool insertion groove 170 having a cross shape is recessed on an exposed end portion of the stopper 165 which is exposed to the outside of the back pressure passage 153 such that a tool for turning the stopper 165, such as a flat head screwdriver or a cross head screwdriver can fit into the tool insertion groove 170. Here, the tool insertion groove 170 can be constructed as a wrench groove in order that a hexagonal wrench can be inserted thereinto.

In addition, a suction pressure hole 159 for connecting the back pressure passage 153 with the suction pressure space (S1) is penetratingly formed in the back pressure passage 153 such that a high temperature gas in the suction pressure space (S2) can quickly flow toward the motor part 121 when the discharge pressure hole 155 is opened.

Figure 7:
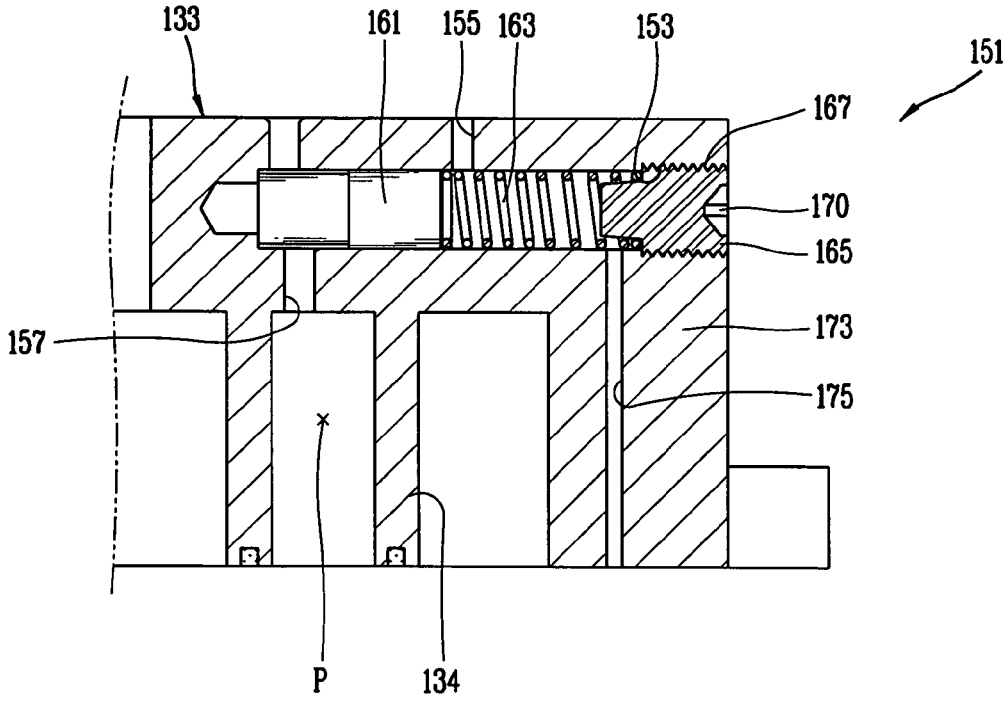
FIG. 7 is a longitudinal sectional view showing a scroll compressor having the vacuum preventing structure in accordance with another embodiment of the present invention.

Meanwhile, FIG. 7 is a longitudinal sectional view showing a scroll compressor having a vacuum preventing structure in accordance with another embodiment of the present invention.

As shown in FIG. 7, a thick wall portion 173 in which one part is thicker than the other part in the fixed scroll 133 is formed, and a suction pressure hole 175 perpendicular to the back pressure passage 153 can be formed at the thick wall portion 173.

Hereinafter, the operation of the scroll compressor having the vacuum preventing structure in accordance with one embodiment of the present invention having a suction construction will be described with reference to FIGS. 3 to 5.

When assembling the scroll compressor, a user can easily assemble the stopper 165 in the back pressure passage 153 by inserting the piston 161 and the spring 163 into the back pressure passage 153, fitting a tool (not shown) into the tool insertion groove 170 of the stopper 165 in a state that the guide portion 167 of the stopper 165 is inserted in the back pressure passage 153, and screw-coupling the stopper 165 in the back pressure passage 153 by turning the stopper 165.

Meanwhile, in case of the normal operation of the compressor, while a refrigerant gas is sucked and compressed, by the action of pressure of the compression space (P), the piston 161 moves to a position where the discharge pressure hole 155 is closed. At this time, the spring 163 is compressed and accumulates an elastic force.

On the other hand, in case of the abnormal operation, in a state that the suction of the refrigerant into the casing 111 is stopped, the pressure of the compression space (S1) is reduced when the compression is performed, and by the elastic force of the spring 163, the piston 161 moves to a position where the discharge pressure hole 155 is opened. Accordingly, the high temperature refrigerant gas existing in the discharge pressure space (S2) flows into the back pressure passage 153, and the introduced high temperature refrigerant gas quickly flows toward the motor part 121 through the suction pressure hole 159. When the high temperature refrigerant gas flows toward the motor part 121, a device protecting against overload (not shown) is operated to thereby stop the driving of the motor part 121, whereby the inside of the casing 111 is early prevented from being in a high vacuum and therefore damage by fire, deterioration and breakdown of the parts due to the vacuum operation can be effectively prevented.

As so far described, in accordance with the present invention, the stopper can be easily assembled in the back pressure passage without using the fixing pin, and the conventional problem that surroundings of the pin hole is fragile can be solved.

In addition, since a refrigerant gas of the discharge pressure space quickly flows to the suction pressure space through the suction pressure hole connected to the back pressure passage without resistance, damage by fire, deterioration and breakdown of the parts due to a high vacuum in the casing during the abnormal operation can be effectively prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A scroll compressor having a vacuum preventing structure comprising:

a casing forming a receiving space therein;

a fixed scroll fixed to a main frame installed in the casing, and including a back pressure passage at an outer side surface thereof, a discharge pressure hole formed at an upper portion of the back pressure passage such that the back pressure passage and a discharge pressure space of the casing can communicate with each other, a middle pressure hole formed at a lower portion of the back pressure passage such that the back pressure passage and a compression space of the casing communicates with each other, and a suction pressure hole formed at the lower portion of the back pressure passage such that the back pressure passage and a suction pressure space communicates with each other;

an orbiting scroll positioned between the fixed scroll and the main frame and forming a compression space by being coupled with the fixed scroll;

a piston slidably installed in the back pressure passage, for opening or closing the discharge pressure hole;

an elastic member installed in the back pressure passage, for supporting the piston; and a stopper for closing the back pressure passage installed at an inlet of the back pressure passage.

2. The scroll compressor having a vacuum preventing structure of claim 1, wherein the back pressure passage has a longitudinal axis that is formed in parallel with an upper surface of the fixed scroll.

3. The scroll compressor having a vacuum preventing structure of claim 1, wherein the suction pressure hole is inclined with respect to the back pressure passage.

4. The scroll compressor having a vacuum preventing structure of claim 1, wherein the suction pressure hole is perpendicular to the back pressure passage.

5. The scroll compressor having a vacuum preventing structure of claim 1, wherein a female screw is formed on an inner circumferential surface of an inlet the back pressure passage, and correspondingly a male screw is formed on an outer circumferential surface of the stopper.

6. The scroll compressor having a vacuum preventing structure of claim 1, wherein a guide portion is formed on an end of the stopper.

7. The scroll compressor having a vacuum preventing structure of claim 1, wherein a tool insertion groove is formed on an end of the stopper.

8. A scroll compressor having a vacuum preventing structure comprising:

a casing forming a receiving space therein;

a fixed scroll fixed to a main flame installed in the casing, and including a back pressure passage at an outer side surface thereof, a discharge pressure hole formed at an upper portion of the back pressure passage such that the back pressure passage and a discharge pressure space of the casing communicates with each other, and a middle pressure hole formed at a lower portion of the back pressure passage such that the back pressure passage and a compression space of the casing communicates with each other;

an orbiting scroll positioned between the fixed scroll and the main frame and forming a compression space by being coupled with the fixed scroll;

a piston slidably installed in the back pressure passage, for opening or closing the discharge pressure hole;

an elastic member installed in the back pressure passage, for supporting the piston; and a threaded stopper for closing the back pressure passage at an inlet located at the outer side surface of the back pressure passage.

9. The scroll compressor having a vacuum preventing structure of claim 8, wherein the back pressure passage has a longitudinal axis that is formed in parallel with an upper surface of the fixed scroll.

10. The scroll compressor having a vacuum preventing structure of claim 9, further comprising a suction pressure hole which is inclined with respect to the back pressure passage.

11. The scroll compressor having a vacuum preventing structure of claim 9, further comprising a suction pressure hole which is perpendicular to the back pressure passage.

12. The scroll compressor having a vacuum preventing structure of claim 8, wherein a female screw is formed on an inner circumferential surface of an inlet of the back pressure passage, and correspondingly a male screw is formed on an outer circumferential surface of the stopper.

13. The scroll compressor having a vacuum preventing structure of claim 8, wherein a guide portion is formed on an end of the stopper.

14. The scroll compressor having a vacuum preventing structure of claim 8, wherein a tool insertion groove is formed on an end of the stopper.

15. The scroll compressor having a vacuum preventing structure of claim 8, wherein a suction pressure hole is formed at still another side of the back pressure passage such that the back pressure passage and a suction pressure space of the casing can communicate with each other.

16. A scroll compressor having a vacuum preventing structure comprising:

a casing forming a receiving space therein;

a fixed scroll fixed to a main frame installed in the casing, and including a back pressure passage having first and second end portions and side portions at an outer side surface of the fixed scroll, a discharge pressure hole formed at one side portion of the back pressure passage such that the back pressure passage and a discharge pressure space of the casing can communicate with each other, a middle pressure hole formed at another side portion of the back pressure passage such that the back pressure passage and a compression space of the casing communicates with each other, and a suction pressure hole formed at still another side portion of the back pressure passage such that the back pressure passage and a suction pressure space communicates with each other;

an orbiting scroll positioned between the fixed scroll and the main flame and forming a compression space by being coupled with the fixed scroll;

a piston slidably installed in the back pressure passage, for opening or closing the discharge pressure hole;

an elastic member installed in the back pressure passage, for supporting the piston; and a threaded stopper installed at an inlet of the back pressure passage for closing one end of the back pressure passage.

17. A scroll compressor having a vacuum preventing structure comprising:

a casing forming a receiving space therein;

a fixed scroll fixed to a main frame installed in the casing, and including a back pressure passage having first and second end portions and side portions and being located within and adjacent to an outer side surface thereof, a discharge pressure hole formed at one side portion of the back pressure passage such that the back pressure passage and a discharge pressure space of the casing communicates with each other, and a middle pressure hole formed at another side portion of the back pressure passage such that the back pressure passage and a compression space of the casing communicates with each other;

an orbiting scroll positioned between the fixed scroll and the main frame and forming a compression space by being coupled with the fixed scroll;

a piston slidably installed in the back pressure passage, for opening or closing the discharge pressure hole;

an elastic member installed in the back pressure passage, for supporting the piston; and a threaded stopper installed at an inlet of the back pressure passage for closing an end portion of the back passage.

* * * * *